United States Patent [19]

Krueger

[11] Patent Number: 4,878,621

[45] Date of Patent: Nov. 7, 1989

[54] PROJECTING GUN AND NOZZLE

[76] Inventor: Michael J. Krueger, 812 Cleveland Ave., Kaukauna, Wis. 54130

[21] Appl. No.: 274,649

[22] Filed: Nov. 18, 1988

Related U.S. Application Data

[63] Continuation of Ser. No. 62,682, Jun. 16, 1987, abandoned.

[51] Int. Cl.[4] ..... B05B 1/26

[52] U.S. Cl. ..... 239/458; 239/514; 239/526

[58] Field of Search ..... 239/456–458, 239/514, 526, 539, 541

[56] References Cited

U.S. PATENT DOCUMENTS

| | | | |
|---|---|---|---|
| 2,121,747 | 6/1938 | Scholtes | 239/458 |
| 2,141,868 | 12/1938 | Kenney | 239/458 |
| 2,474,332 | 6/1949 | Sciuto | 239/458 |
| 2,511,627 | 6/1950 | Einbecker | 117/104 |
| 2,737,415 | 3/1956 | Wheeler-Nicholson | 299/86 |
| 2,991,945 | 7/1961 | Rosenkranz | 239/526 |
| 3,042,318 | 7/1962 | Ho Chow et al. | 239/458 |
| 3,930,619 | 1/1976 | Levey et al. | 239/526 |
| 3,936,002 | 2/1976 | Geberth . | |
| 4,126,272 | 11/1978 | Geberth . | |
| 4,220,286 | 9/1980 | Geberth . | |
| 4,251,573 | 2/1981 | Holm et al. | 427/236 |

FOREIGN PATENT DOCUMENTS

| | | | |
|---|---|---|---|
| 452224 | 8/1936 | United Kingdom | 239/458 |
| 681982 | 11/1952 | United Kingdom . | |
| 1480335 | 7/1977 | United Kingdom . | |

*Primary Examiner*—Andres Kashnikow
*Assistant Examiner*—Michael J. Forman
*Attorney, Agent, or Firm*—Thomas D. Wilhelm

[57] ABSTRACT

A nozzle, and gun for using the nozzle for projecting material outwardly therefrom. The gun has means for receiving a supply of material and a valve for controlling passage of material through the gun. The nozzle has a housing, and a passage in the housing. The passage has first and second ends and a longitudinal axis. The passage extends, from its first end, into the interior of the housing and opens into a chamber in the housing at the second end of the passage. The first end of the passage has a first surface flared outwardly at an average angle no greater than 75 degrees from the longitudinal axis. A shaft extends from the chamber through the passage and terminates, at a tip, at a location adjacent the first end of the passage. The shaft is positioned in the passage to provide a symmetric orifice between the passage and the shaft. The tip has a second surface flared outwardly at least 15 degrees from the longitudinal axis. The first and second surfaces cooperate, in projection of drywall coating material through the nozzle at pressures of 1,000 psi to 1,500 psi, to break up the drywall material into discreet particles and thereby create a substantially uniform pattern. The nozzle further includes means for introducing the material, to be projected, into the chamber.

21 Claims, 6 Drawing Sheets

PROJECTING GUN AND NOZZLE

This application is a continuation of application Ser. No. 062,682 filed Jun. 16, 1987, now abandoned.

BACKGROUND OF THE INVENTION

This invention pertains especially to applying a surface coating of a texturizing material over a drywall base substrate. It applies especially to applying the material in an economical and highly efficient operation. It is especially sensitive to applying a uniform textured coating that is adaptable in its ability to apply a variety of textures, and that provides a commercially acceptable texture.

A texture coating is used for several purposes. First, it is used as a base for applying paint. Second, it is used to cover imperfections in the drywall and its installation. Third, it is typically used to lend a surface texture to the wall being coated.

Coating material is conventionally applied to the drywall with a trowel or similar blade-type tool. After the material is applied, a texture is then imparted as by a dabbing motion, or by a sweeping motion of a patterned edge of, for example, the trowel.

Applying the coating to a vertical surface, or a ceiling, and having it stick to the surface, requires a significant amount of skill on the part of the person doing the work. Also, the work can be slow and tedious. The coating material, on the other hand, is relatively inexpensive. Thus, a significant portion of the cost of applying the coating is the cost of the labor involved in actually putting the material on the wall and creating a texture in it.

This invention also pertains to guns, and nozzles for projecting a material outwardly from the gun through the nozzle. The gun typically includes a means for receiving material from a supply source. This receiving means is conveniently a coupling which can receive a supply hose or other connector means. The gun also includes a valve for starting flow of the material through the gun, for stopping flow of the material, and for generally regulating the rate of flow of material through the gun. Material is projected from the gun typically through an orifice which is conventionally referred to as a nozzle. This invention pertains especially to improvements in design of the nozzle, and guns using the improved nozzles of the invention.

Conventionally, nozzles are known for spraying paint, lacquers, and the like-relatively low viscosity materials. Generally, a uniformly-dispersed surface coating is desired, and significant attention is usually directed toward obtaining a uniform coating surface. Such nozzles typically have a circular, elliptical, or slot-shaped opening. Typical of such nozzles are slit 9 in U.S. Pat. No. 2,737,415 and elliptical opening 82 in U.S. Pat. No. 3,930,619. Projection of conventional drywall coating material through these nozzles leads to totally unsatisfactory results. Satisfactory projection of this material through a nozzle is not believed to have previously been done. At ordinary pressures and using ordinary airless spray equipment, including ordinary nozzles, material which is capable of holding a texture cannot be projected with an acceptable degree of break-up of the material into the desired particles. Rather, the material comes out in streams and chunks.

The coating can be projected from an airless gun as in U.S. Pat. No. 3,930,619 by removing the nozzle and letting the material project as from the openings 28*d* and 48*a*, wherein a passage opens from the valve seat without passing through a patterning nozzle. While particles may be projected by such openings, a uniform pattern has not been obtainable thereby. An elongated path beyond the valve typically results in a stream, without an acceptable amount of break-up of the material into particles. A shorter path typically results in a non-uniform pattern.

It is not so necessary to completely atomize the coating material as it is to project it in discrete particles which will adhere to the drywall in esentially the projected pattern. The particles should range in size up to no more than about 2 centimeters diameter, preferably about 1 cm., depending on the preference of any one particular customer. Particle size is measured as the splattered particle on the drywall substrate. The pattern should include a range of particles down to about 0.1 cm, with an overall background coating.

It is not believed that any means has previously been provided for applying drywall coating compound with airless spray equipment, where the coating compound is projected as particles which provide a textured surface. The inventor herein has conceived that it may be possible to project the desired particle sizes by use of air-atomizing spray equipment. However, that equipment is several times more costly than airless equipment. It is more bulky, and thus less adaptable to being moved about the interior of a building to do the job. Further, the greater bulk of the air atomizing equipment requires more trucking capability to move it to and from the job site. Thus is the airless operation highly desired if a satisfactory spray pattern can be developed.

For use in applying a coating compound over drywall, it would be desirable to be able to control the relative size of the particles of material projected from the nozzle. In some cases it is desirable that all the particles be relatively fine in order to apply a fine textured, and uniform coating. In other circumstances, it is more desirable to have a rougher textured coating, such that the particle size range includes some larger particles. Thus the nozzle should incorporate some means for adjusting the size of the particle which is being projected from the gun.

It is an object of this invention to provide a novel gun, and novel means, for projecting material therefrom.

It is a further object of the invention to provide a novel nozzle which is capable of projecting material in a substantially controllable pattern.

It is yet another object to provide the capability, in the nozzle and the gun, of adjusting the range of the sizes of the particles projected from the gun.

SUMMARY OF THE INVENTION

The invention is readily seen in a gun for projecting material outwardly therefrom, the gun incorporating therein a novel nozzle. The gun has means for receiving a supply of material, a valve for controlling passage of material through the gun, and the nozzle for projecting the material from the gun.

The nozzle has first and second ends, has a housing having first and second ends, and a passage in the housing. The passage has first and second ends and a longitudinal axis. The passage extends, from its first end, which corresponds to the first end of the housing and the first end of the nozzle, into the interior of the housing and opens into a chamber in the housing at the second end of the passage. The chamber is defined by a plurality of interior walls. The first end of the passage is outwardly flared at an average angle no greater than 75 degrees from the longitudinal axis.

A shaft extends from the chamber through the passage and terminates, in a tip, at a point adjacent the first end of the passage. The shaft has a longitudinal axis corresponding to the longitudinal axis of the passage. The tip is flared outwardly at least 10 degrees from the longitudinal axis. The dimensions of the shaft, including the tip, are compatible with passing the shaft through the passage.

The angle of flare on the first end of the passage is no more than 20 degrees less, nor more than 30 degrees greater, than the angle of flare on the tip. The nozzle further includes means for introducing the material, to be projected, into the chamber.

The nozzle has a continuous path, at all operating conditions, including shut-off of flow of the projectable material, from the means for introducing the material into the chamber through the chamber and out the first end of the passage.

It is preferred that the angles of flare on both the tip and the first end of the passage be between 20 degrees and 40 degrees from the longitudinal axis, most preferably between 20 degrees and 30 degrees.

Typically the housing comprises male and female nozzle members. The female nozzle member defines the passage and a first portion of the cavity walls. The female nozzle member has first and second ends. Its first end corresponds to the first end of the nozzle. The female nozzle member fits over the male nozzle member, with the male nozzle member defining a second portion of the cavity walls. A seal member is positioned between the second end of the female nozzle member and the means for introducing material into the chamber.

The means for introducing material into the chamber preferably comprises one or more transverse holes in the male nozzle member and communicating with a longitudinal hole extending from there to the second end of the nozzle. Typically, the nozzle also includes means to longitudinally position the shaft, including the tip, with respect to the first end of the passage, and includes means for indicating to an operator of the nozzle the normal operating range of that positioning.

DETAILED DESCRIPTION OF THE ILLUSTRATED EMBODIMENTS

Figure 1:
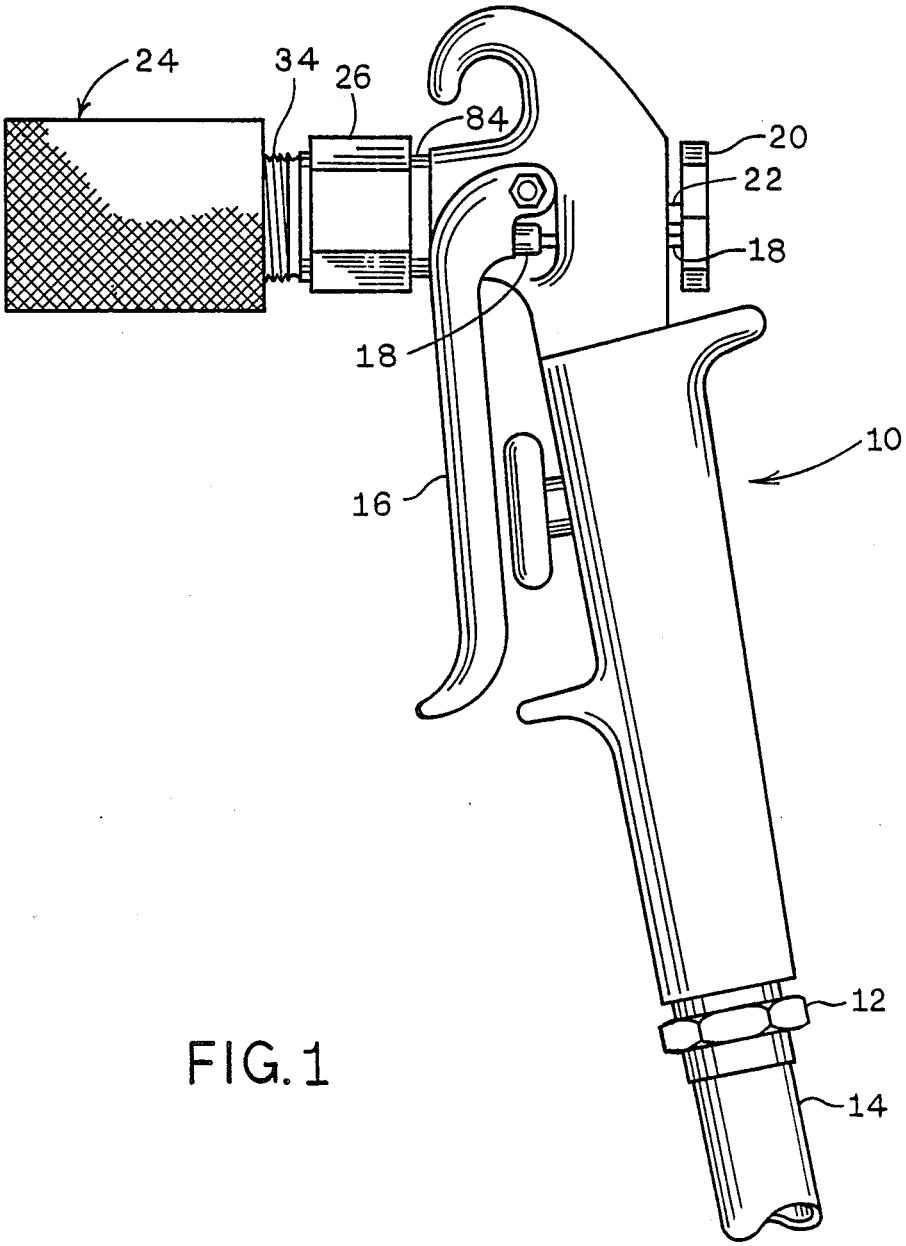
FIG. 1 is a pictorial view of a projecting gun of the invention, and including a nozzle of the invention.

Referring now to FIG. 1, the projecting gun generally designated 10 has a coupling 12 for receiving a supply hose 14 for carrying the coating material to be projected from the source of supply not shown. A trigger 16 pushes against pusher 18 which coacts with interface 20 to position needle valve 22, and thus to control the flow of material through the gun. The nozzle, generally designated 24 is connected to the gun by means of coupling 26. Inside coupling 26, needle valve seat 28 interfaces with nozzle 24 by means of interposed seal member 30 as seen in FIG. 2.

Figure 2:
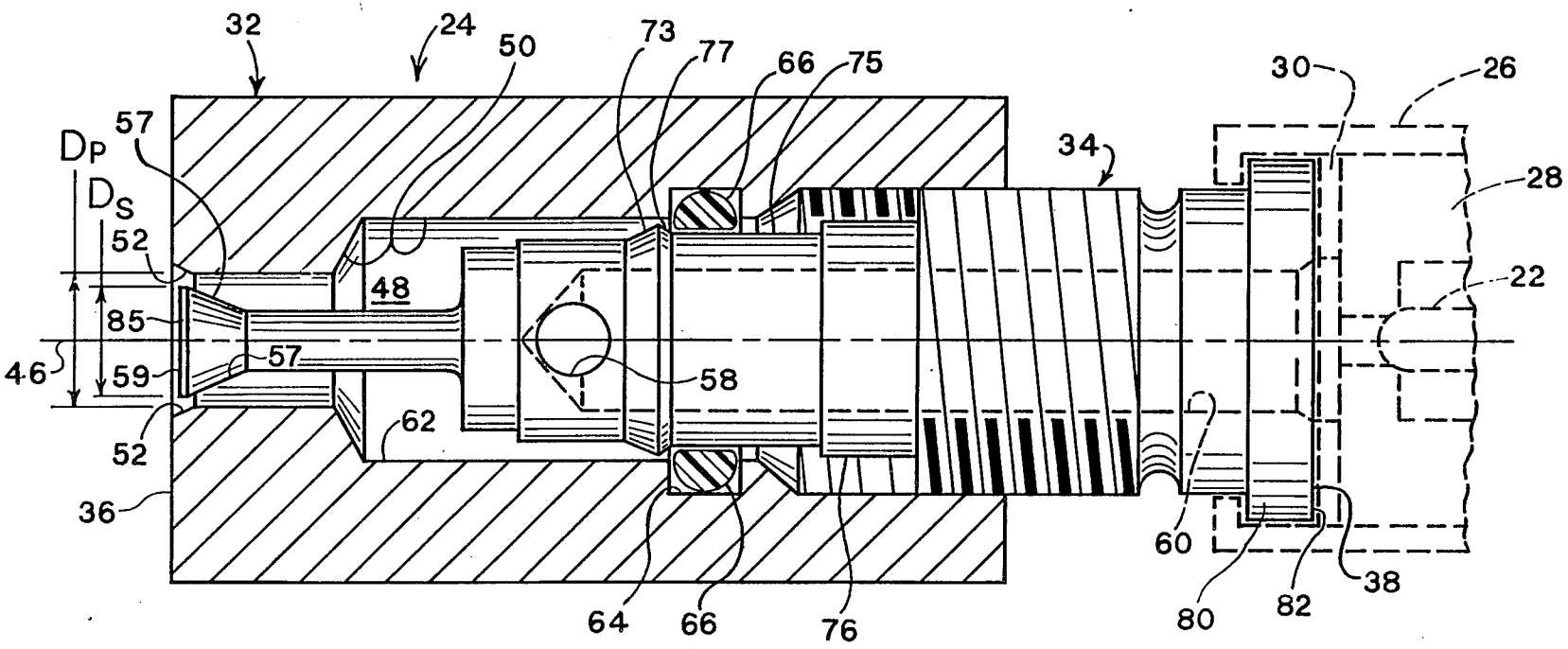
FIGS. 2 and 3 show side views of the nozzle, with the female nozzle member and the seal member in cross-section, and showing the interior relationships in the nozzle between the male and female members.

Through a conventional flow control activated by trigger 16, material is caused to flow through the gun by pulling trigger 16 such that pushers 18 and interface 20 coact together to draw the end of the needle valve 22 away from needle valve seat 28, thus providing a communicating channel between the main body of gun 10 and nozzle 24; the communicating channel being between the tip of needle valve 22 and the adjoining portions of needle valve seat 28 as seen by referring to FIGS. 1 and 2.

Referring now to FIG. 2, nozzle 24 is generally comprised of a female nozzle member 32 and a corresponding male nozzle member 34.

A description of the nozzle is seen to be readily understood by referring to first and second ends of the several parts. The nozzle has a first end 36 and a second end 38 as seen in both FIGS. 2 and 3. The nozzle can be considered as comprising a housing which is composed of the combination of female nozzle member 32 and male nozzle member 34. The housing has first and second ends corresponding to the first and second ends 36 and 38 of the nozzle. Passage 40 has a first end 42 corresponding to the first end 36 of the nozzle and a second end 44. See FIG. 4. Nozzle 24 has a longitudinal axis 46 which corresponds in the assembly with the longitudinal axes of female member 32, male member 34, and passage 40. All four axes are indicated as 46 on all of the drawings for sake of simplicity.

Passage 40 leads into the interior of the housing and opens at its second end 44 into a chamber 48. Chamber 48 is defined by a plurality of walls 50 on the interior of the housing.

Figure 3:
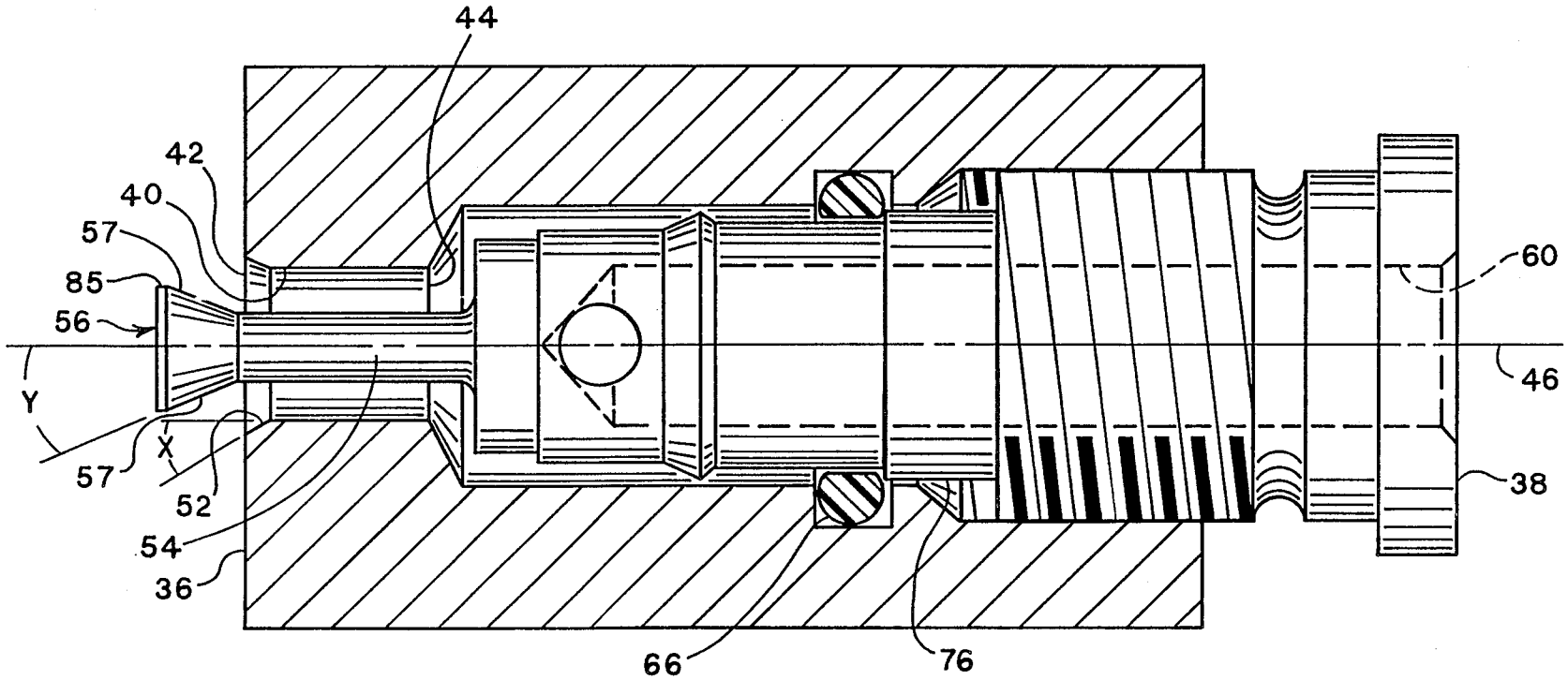

The first end 42 of passage 40 is outwardly flared as at beveled surface 52 at an angle "X" no greater than 75 degrees from the longitudinal axis. It should be noted in FIG. 4 that the angle X is designated between extensions of the sidewall of passage 40 and the surface 52. As seen in FIGS. 2 and 3, and for purposes of designation of X, the extension of the sidewall of passage 40 and longitudinal axis 46 are parallel to each other. As seen in FIGS. 2 and 3, the constant cross-sectioned space between shaft 54 and the walls of passage 40 extends between the interior end of passage 40 and the first-to-be-encountered of flared surfaces 52 and 57. The exact point of encounter, and which flared surface is encountered first will, of course, depend on how far female element 32 has been advanced onto male element 34, and the corresponding position of tip 56 in passage 40.

In the preferred embodiments, passage 40 is somewhat elongated as in the illustrated embodiments, in order to encourage alignment of flow of the coating material with the general direction of projection. Thus, the ratio of (i) the length of passage 40, between its first and second ends 42 and 44 respectively, and (ii) the diameter of the constant cross-sectioned portion of passage 40 as at "Dp" is at least 0.3/1, preferably at least 0.5/1, most preferably at least 0.8/1.

A shaft 54 extends from chamber 48 through passage 40 and terminates at a tip 56 at a point adjacent the first end 42 of the passage. Shaft 54 has a central longitudinal axis corresponding to the longitudinal axis of the passage, and surface 57 is flared outwardly at an angle "Y"

of at least 10 degrees from the longitudinal axis. Angle X is no more than 20 degrees less, nor more than 30 degrees greater, than angle Y. The diameter "$D_5$" of shaft 54, including the tip, is smaller than the diameter "Dp" of the passage, such that the shaft and the tip are compatible with passing entirely through the passage.

Nozzle 24 includes a hole 58 transversely through male member 34 and communicating with a longitudinal hole 60 extending from transverse hole 58 through the male member 34 to the second end 38 of the nozzle.

Figure 4:
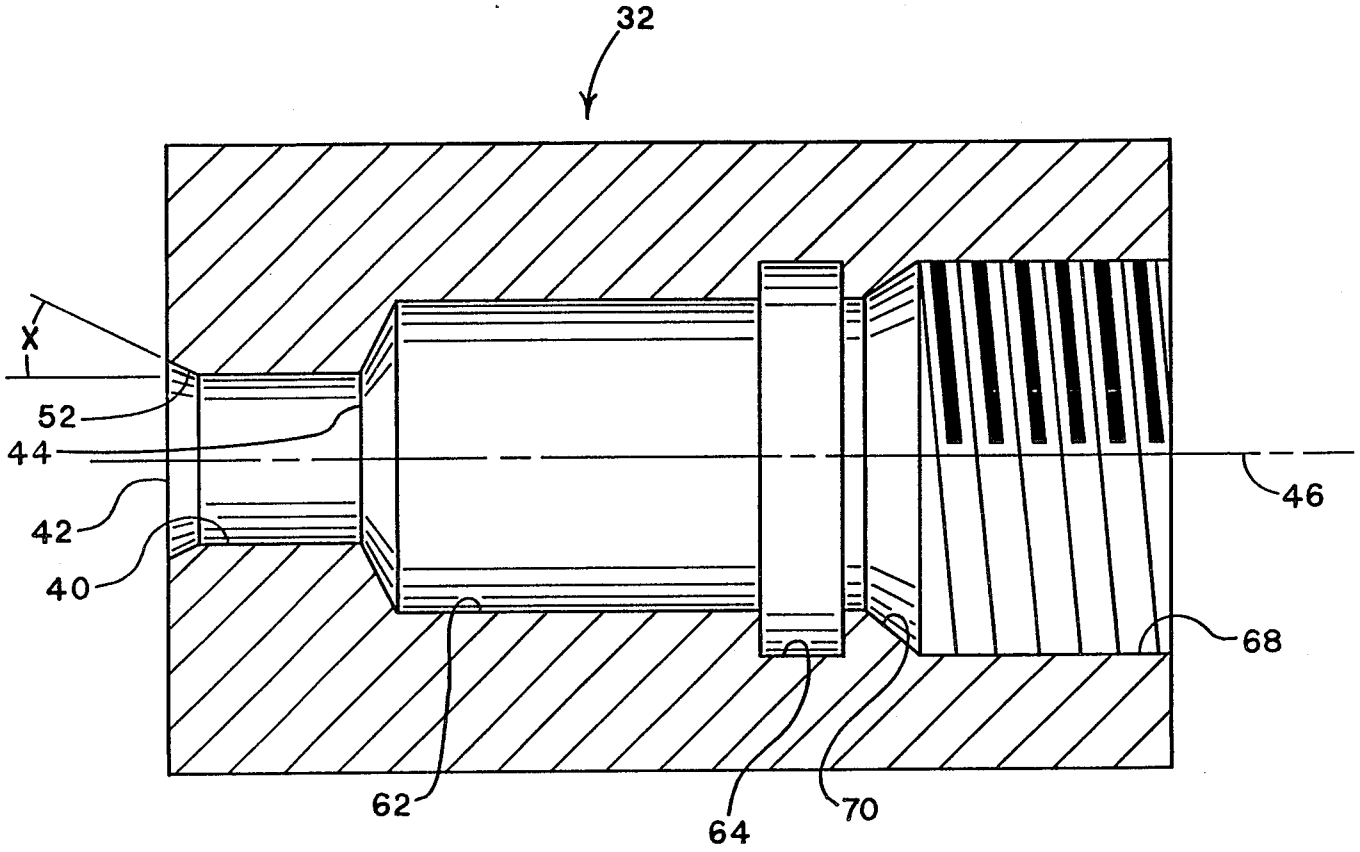
FIG. 4 is a cross-section of a female nozzle member of the invention.

Referring now to FIGS. 2 and 4, the interior wall 62 which opens from the second end 44 of passage 40 generally defines, in part, the outermost ones of interior walls 50 of cavity 48. Annular ring 64 adjoins the end of wall 62, and conjointly the rearward end of cavity 48; and provides a seating location for seal member 66. Seal member 66 is seen in FIGS. 2 and 3, and prevents leakage, of the pressurized coating material which flows through nozzle 24, out the rear of the nozzle between male and female nozzle members 34 and 32 respectively.

Referring again to FIG. 4, female threaded portion 68 generally adjoins annular ring 64 through a tapered annulus 70.

Figure 5:
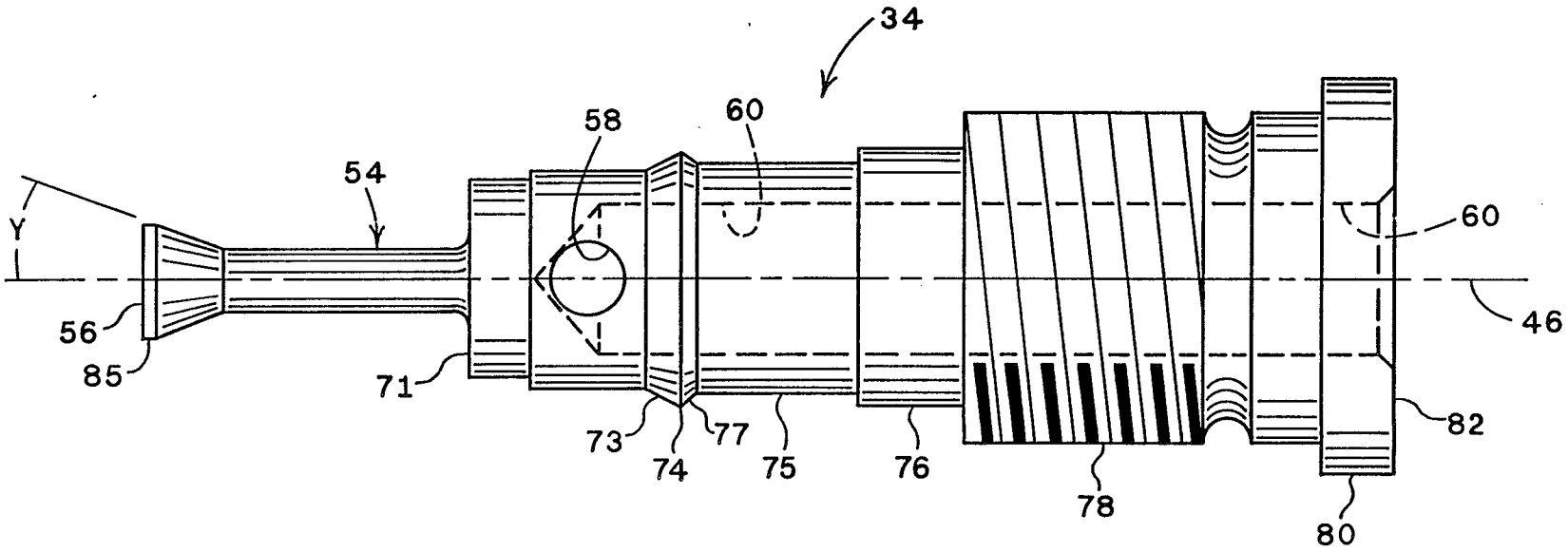
FIG. 5 is a side view of a male nozzle member of the invention.

Male member 34 is seen in general detail in FIG. 5. Shaft 54 extends from the first end 71 of the male member 34. Male member 34 extends generally rearwardly, as defined in the nozzle, from end 71 to a first shoulder 73 which extends outwardly from the body of the shaft at an angle of between 10 degrees and 60 degrees, preferably between 15 degrees and 40 degrees, most preferably between 20 degrees and 30 degrees, from the longitudinal axis 46. From its apex 74, which may be slightly rounded, shoulder 73 extends back toward longitudinal axis 46 at an angle of between 30 degrees and 75 degrees from longitudinal axis 46. Bearing zone 75 extends from first shoulder 73 to a second shoulder 76. External threads 78 generally adjoin the second shoulder 76. Finally, flange 80 defines the second end 82 of the male member of the nozzle, which generally corresponds with the second end 38 of the nozzle assembly as seen in FIG. 2.

Referring now to FIG. 2, nozzle 24 is joined to the projecting gun 10 by means of flange 80 being held by coupling 26. The nozzle as seen in FIGS. 2 and 3 is assembled to gun 10 by inserting male member 34 through coupling 26, with shaft 54 of male member 34 being subsequently inserted into female member 32 from the second end of female member 32. The threads 78 of male member 34 engage the threads 68 of female member 32. As threads 68 and 78 are further engaged, shoulder 73 engages seal member 66, which has previously been emplaced in annular ring 64. Shoulder 73 engages seal member 66 with its leading angular member, thus compressing seal member 66 as the threading of female member 32 over male member 34 continues; such that shoulder 73 is able to pass resiliently deformable seal member 66 and reach a position as seen in FIG. 2, wherein seal member 66 is between first shoulder 73 and second shoulder 76. After the passage of the first shoulder 73, seal member 66 conforms to the surface of bearing zone 75 and applies sealing pressure against it. Seal member 66 thus prevents the passage of any material from cavity 48 out the rear of the nozzle.

In the position depicted in FIG. 2, the end of tip 56 is moderately recessed within passage 40 adjacent the first end 36 of the nozzle, and the flared surfaces 57 and 52 of tip 56 and passage 40 respectively are somewhat adjacent each other. Flared surface 57 on tip 56 tends to direct material flowing past it in an outwardly direction, and to compress it outwardly toward the wall of passage 40. Passage 40 accommodates that outwardly directed compression by means of the corresponding outwardly flared surface 52 at its first end, to thus outwardly relieve the compression applied by surface 57. If only one of the tip and the passage are flared outwardly, the benefits reported herein are not achieved. Indeed, if only tip 56 is flared, the drywall coating compound herein described is projected more as strings than as particles, or even globules. If only passage 40 is flared as at 52, the material is generally projected as a stream. The desired pattern is that of discrete particles, generally uniformly dispersed. While the magnitude of the X and Y angles are defined herein within relatively expansive ranges, it is seen that the existence of both flare angles is critical to the satisfactory functioning of the nozzle. It is preferred that angle X be at least as great as angle Y, and it may be greater than angle Y by up to 30 degrees, preferably no more than 10 degrees. Angle X can be less than angle Y, but no more than 20 degrees less, preferably no more than 5 degrees less. Thus the cooperation between angles X and Y is seen to be a primary consideration in the functioning of the nozzles of the invention. It is contemplated that the most advantageous cooperation is achieved when angles X and Y are identical, and wherein the body of material exiting the nozzle is acted on by both surfaces 52 and 57 before essentially complete break-up into individual particles has occurred.

In general, the nozzle 24 operates at substantial pressures of about 1,000 psi to 1,500 psi with conventional contractor's airless spray equipment. In those operating ranges, there is substantial turbulence within the nozzle. It is desirable that the flow of the material be somewhat aligned with the direction of projection before it actually reaches the flared nozzle surfaces 52 and 57 at end 36. It is seen in, for example, FIG. 3 that the cross-section of the space between the interior walls of passage 40 and shaft 54 is generally constant. The material is thus conditioned by the length and configuration of passage 40, whereby it flows through passage 40 in a direction generally parallel to axis 46, in the most preferred embodiments, whereby its direction of flow is believed to be stabilized such that it is prepared for accepting the directions given at surfaces 57 and 52. In achievement of this conditioning, it is desired that passage 40 have a length to diameter ratio of at least 0.3 to 1, most preferably at least about 0.8/1 up to about 1.75/1.

Another consideration with respect to performance of the nozzles of the invention is the relationship between shaft 54 and passage 40. In order to achieve a symmetric pattern of projection from nozzle 24, it is important that the orifice between passage 40 and shaft 54, be symmetric at the point where the material passes beyond the tip 56, and where it passes beyond passage 40. Preferably, the symmetry extends through passage 40. In the illustrated embodiment, passage 40 and shaft 54, including tip 56, are circular, with shaft 54 and tip 56 being concentric with respect to passage 40. Thus the orifice in the illustrated embodiment (i.e., FIG. 2) is a circular ring-like opening of constant cross-section, typically about 0.001 to about 0.002 inch across the opening at any given point. To the degree that shaft 54 is not concrete with respect to passage 40, a larger quantity of the coating material is projected through the larger portion of the opening, usually with an associated increase in the particle size range (as compared to the smaller cross-section portion of the opening), and an asymmetry in the projected pattern occurs. With tip 56 centered in passage 40, it is typical that the longitudinal axis of shaft 54 correspond with longitudinal axis of passage 40, as illustrated herein.

Referring now to FIG. 3 it is seen that tip 56 projects substantially beyond the first end 36 of the nozzle. This positioning is achieved by threading female member 32 further onto male member 34 such that the seal member 66 reaches an abutment relationship with second shoulder 76.

Figure 6:
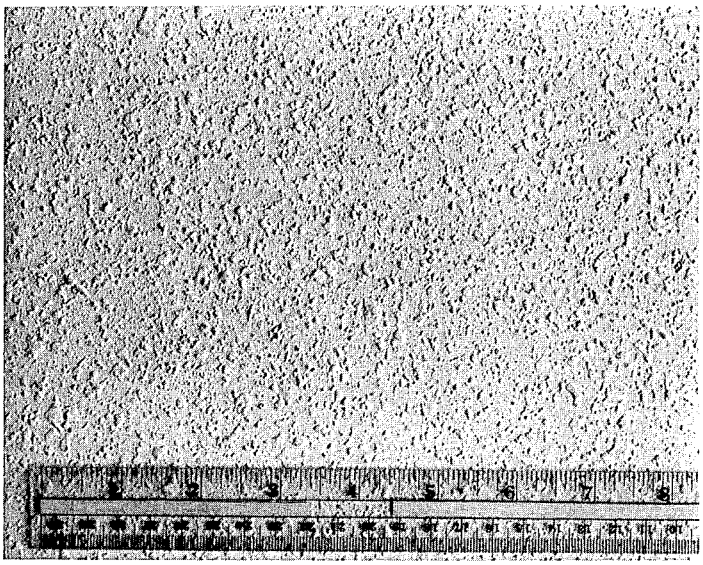
FIG. 6 is a pictorial representation of a typical splatter pattern applied by a nozzle of this invention.

The pattern of material projected from the nozzle is altered according to the positioning of tip 56 relative to the flared end of passage 40. In the position shown in FIG. 2, generally liquidous material projecting from the nozzle is generally broken into fine particles having a relatively narrower range of particle volumes. The texture pattern projected onto drywall is fine and uniform, resembling most closely a sand pattern. FIG. 6 represents a typical pattern wherein the end 59 of tip 56 is essentially flush with the first end 36 of the nozzle. Material projected from the nozzle which is set as in FIG. 3 encounters much less interference between shaft 54 and passage 40 as it passes outwardly therethrough; and thus larger particles, and globules are common characteristics of the projected material when the shaft 54 is positioned as seen in FIG. 3. In addition there is an increase in the rate of liquid flow due to the larger orifice opening. The more the nozzle setting approaches that of FIG. 3, the larger are the largest particles projected from the gun. There are always some fine particles. The maximum size and the frequency, of the large particles is readily controlled by adjusting the shaft 54 in passage 40 between the settings of FIGS. 2 and 3.

With any of the settings, the projected material resembles a splatter more than a conventional spray. The larger the orifice opening as set on the nozzle, the more noticeable is the splatter affect as compared to a fine spray. In typical patterns, particles in the pattern, after drying on the drywall are typically up to 1 or 2 mm. or more thick, and represent discrete globules.

The patterning and break-up of the coating material is related to the viscosity of the material as it flows through gun 10, as well as to the opening between shaft 54 and passage 40. The lower the viscosity, in aqueous base, the easier it is to break into particles. The higher the viscosity, the more difficult it is to break into particles. Thus, the capability to spray drywall coating using the nozzle and gun of the invention depends, in part, on having the correct fluidity/viscosity coating material being fed through the gun. The coating material most commonly used with nozzles and guns of this invention is made from the troweling consistency coating material commonly available commercially as a pre-mixed paste. It is also available as a powder, which is typically mixed at the rate of 25 pounds of powder to 1.5 gallons of water to make the paste. With the paste as a starting material, a typical coating material for use with the nozzles and guns of this invention is prepared by adding 1 part water to 1 part paste, by volume, and mixing thoroughly to achieve a uniform mixture. More water may be used for a finer nozzle setting, as in FIG. 2. Less water may desirably be used for a coarser nozzle setting as in FIG. 3. Nozzle adjustments can generally be made without changing the material viscosity, although an accompanying viscosity adjustment generally provides the best control.

While it is entirely acceptable to design a nozzle wherein the end surface 59 of tip 56 may be withdrawn inwardly of the flared surface 52 in passage 40, the benefits of the invention are not obtained in that withdrawn position. Thus, nozzles which function as described herein are generally characterized in that a perpendicular from one of the surfaces 52 and 57 will pass through, or within about 2 mm. of, the other of surfaces 52 and 57; this representing a general structural relationship that corresponds to the ability of surfaces 52 and 57 to cooperate with each other in generating the desired dispersion of particles.

It can be seen from FIGS. 2 and 3 that the nozzle includes a continuous path at all conditions of operation, including stoppage of the flow of the pressurized material, between hole 58 where the material enters chamber 48 and the first end 42 of passage 40. Thus there is always, at all conditions of operation, a continuous path for flow of material from chamber 48 to the exterior of the nozzle. It is seen that the means for providing the general control of the flow of material through nozzle 24 is provided by needle valve 22 in its functioning against valve seat 28.

It is further seen from FIGS. 2 and 3 that the exterior surface of male member 34, to the extent it extends from seal member 66 through the first end 71 of male member 34 comprises further portions of the interior walls 50 of cavity 48. Thus cavity 48 is defined by the enclosing walls 50 provided by the combination of a portion of the interior of female member 32, at wall 62, and a portion of the exterior of male member 34.

The assembly of nozzle 24 to gun 10 comprises removing coupling 26 from the gun, and inserting male member 34 through coupling 26 in a direction seen in FIG. 2, as previously described. After the male member 34 has been inserted into coupling 26 then the sequence of assembly may be varied by choice. In any sequence, the coupling 26 is joined to the gun by means of its threads and the threads (not shown) on adapter 84. See FIG. 1. Female portion 32 is placed over male member 34 and turned onto it, as previously described.

As female member 32 is turned onto male member 34, the seal member 66 engages shoulder 73, compressing seal member 66 such that the operator feels a moderate amount of resistance as the seal member 66 passes over shoulder 73. At the point where seal member 66 has passed over shoulder 73 and is engaged against bearing zone 75, the resistance felt by the operator is substantially lessened. Female member 32 may be further turned onto male member 34. As the engagement continues by means of continued turning of female member 32 onto male member 34, seal member 66 approaches and engages second shoulder 76 as seen in FIG. 3. As seal member 66 engages the second shoulder 76, the operator again feels resistance as the seal member is compressed by shoulder 76. Between shoulders 73 and 76, the operator feels a uniform and reduced level of resistance to the turning of female member 32 in adjusting the nozzle pattern between that shown in FIGS. 2 and 3. As the adjustment reaches the positions shown in FIGS. 2 and 3, the operator feels resistance as the seal member engages either shoulder 73 or 76. Thus the shoulders 73 and 76 provide means for indicating to the operator the normal operating range of the nozzle positioning, namely that positioning where seal member 66 is between shoulders 73 and 76.

The nozzle is disassembled by turning female member 32 such that the seal member 66 engages the back angle 77 of shoulder 73, representing one limit of the normal operating range of the nozzle. Seal member 66 is compressed as it passes shoulder 73. Continued turning of female nozzle member 32 eventually releases threads 68 on female member 32 from threads 78 on male member 34 such that the female member may be completely removed; whereby the male and female portions are disassembled from each other.

Assembly is readily understood in turning female nozzle member 32 onto male nozzle member 34. Same could by affected by turning the male member 34, on the gun, into female member 32. Either way, threads 68 and 78 cooperate with each other in joining the male and female members to thus assemble the nozzle 24 onto the gun.

In operation, the gun of the invention, and commensurately the nozzle, is activated by pulling trigger 16 to release needle valve 22 from seat 28, thus providing for flow of material into and through nozzle 24. The material flows past needle valve 22, through longitudinal hole 60 and transverse hole 58, and into cavity 48. From cavity 48, the material travels through passage 40, and impinges generally on the flared surface 57 of tip 56. See FIG. 2. As the material impinges on surface 57, as seen in FIG. 2, it is deflected in a compressive action toward the flared surface 52 of the outer portion of the passage 40. To the extent the passage 40 is flared, the desirable generally uniform pattern is created as the material is projected from the nozzle with an associated break-up of the material into particles. The actual break-up of the material, and the creation of the pattern is seen to be the result of the complex relationship of the turbulent flow of the material, particularly in the area of tip 56, and the cooperation of flared portions 57 and 52 under the anticipated pressure of at least 1,000 psi, preferably up to about 1,500 psi along with the sudden reduction in pressure which obviously occurs as the material passes through the very small orifice opening which, as indicated above, is only about 0.001 to 0.002 inch across. Those skilled in the art of fluid flow will readily see, in hindsight, that such a large pressure drop, through such a small opening, releases a substantial amount of energy which is appropriately directed by the instant novel nozzle.

As trigger 16 is pulled in a conventional airless spray gun apparatus using the novel nozzle 24 herein, a large quantity of material is immediately projected out nozzle 24. The pulling and subsequent releasing of trigger 16 is done in essentially a single action, in combination with the operator sweeping the nozzle 24 along an imaginary path of aim on the wall, such that an essentially instantaneous burst of material coats a typical wall which is desirably 6–8 feet away from the nozzle. Duration of the burst required to coat a typical wall is usually about one second, and usually not over two seconds. Burst duration is also necessarily short as the portable pump typically providing the material pressure typically cannot maintain a constant high pressure in the system during continuous projecting. Thus, intermittent bursts are used, typically 2 or 3 for each wall.

Using the nozzle, gun, and material as described herein, a typical room can be completely splatter-coated in less than a minute. A typical house can be completely coated in less than 1 hour. Thus the labor savings associated with use of the invention are readily apparent and easily measured.

Referring again to FIG. 2, that material which impinges directly on surface 57 is directed outwardly. It passes through the direct path of flow of material flowing through passage 40 which would otherwise be able to exit passage 40 between the outer edge of tip 56 and the inner wall of passage 40. Thus are the paths forced to cross each other and simultaneously respond to the flare of surface 52, creating additional turbulence at the point where the material exits nozzle 40. The result is a substantial breaking up of the material into particles and a distribution of those particles in a generally uniform pattern as previously discussed.

In the opposite extreme setting of the nozzle, and wherein tip 56 is still seen to be adjacent the first end 42 of passage 40, as seen in FIG. 3, the material passing through the passage first encounters the flare at the outer end of passage 40. The flare creates a zone of reduced pressure wherein the break-up of the material into discrete particles is believed to be initiated by a partial vacuum existing through the initial expansion of the cross-sectional area of the passage at surface 52. The material is subsequently treated to a shattering and turbulent impingement as it encounters the angled surface 57 of tip 56. While choosing to not be bound by theory, applicant believes that the impingement on surface 57 is instrumental in effecting the break-up of the material into discrete particles. Applicant has observed that, if the narrowest portion of surface 57 extends substantially beyond first end 42 of passage 40, the material is not projected as a uniform pattern so much as a general stream. Thus the positioning of tip 56 in FIG. 3 is believed to represent a general positioning limit for tip 56 when operating in the range of 1,000 to 1,500 psi. Further projections of tip 56 from first end 42 are contemplated for use at higher pressures.

Thus the functioning of the tip in FIG. 2 resembles that of a compressive type turbulence, whereas the function in FIG. 3 is a combination of (i) expansive turbulence through the creation of a pressure reduction by means of expanded cross-section at surface 52 in passage 40 and (ii) an edge impingement turbulence created by the impingement on flared surface 57 of tip 56, both believed to be occurring with, and cooperating to effect, the break-up of the material into the discrete particles.

In use with drywall coating compound, tip 56 typically wears by abrasion, especially at surface 57. Annular plateau 85 is provided as an extension of the widest dimension of tip 56. Thus, when surface 57 is worn sufficiently, it may be resurfaced, as by turning in a lathe, to restore the original angle to surface 57. By extending the restored surface 57 onto plateau 85 (thus removing part of plateau 85), the original angle on surface 57 may be restored without reducing the overall maximum dimension of tip 56.

A "substantially uniform pattern" as depicted herein resembles the developed pattern of impact of shot from a shotgun at a normal effective range. The distribution is relatively even, tapering off at the edges. In the projected pattern herein, some particle density deviation may occur, but the pattern is generally symmetric. The projected pattern has no significant holes. Minor density deviations can be essentially masked by sweeping the nozzle/gun along a path of aim on the wall during projection of the material from the gun, to thereby create the resulting "substantially uniform pattern". FIG. 6 is representative of the "substantially uniform pattern" of textured splatter which can be applied using the nozzles of the invention.

The illustrated embodiment is seen to be only one of a vast array of possible arrangements of angles and lengths of flares in passage 40 and tip 56, corresponding to surfaces 52 and 57 respectively. As indicated hereinabove, the angles X and Y can be varied substantially. Further, the length of the flared surfaces 52 and 57 can be varied within a substantial range. The critical portion of the invention is that there must be a flare on both tip 56 and passage 40.

While one embodiment, and a few variations have been described, it is seen that substantial deviation can be made from the specific embodiment disclosed, without departing from the spirit of the invention. Thus the invention is not intended to be limited solely by the description herein but rather by its definition in the appended claims.

Having thus described the invention, what is claimed is:

1. A nozzle comprising a housing having a first end, and a passage in said housing, said passage having first and second ends and a longitudinal axis, said passage extending, from said first end of said housing at said first end of said passage, into the interior of said housing, and opening into a chamber in said housing at said second end of said passage, said first end of said passage having a first surface flared outwardly, a male member in said housing, having an end disposed toward said first end of said passage, a shaft comprising an elongated constant cross-sectioned portion extending from said end of said male member and from said chamber, through said passage, and an enlarged tip extending from said constant cross-sectioned portion, at a location adjacent said first end of said passage, said enlarged tip having a second surface flared outwardly from said constant cross-sectioned portion of said shaft, means for introducing a material into said chamber for dispensing said material through said passage, adjusting means for adjusting the position of said shaft longitudinally in said passage within an operating range, for modifying the pattern of dispensing of said material, including a full open position at a first end of said range wherein said end of said male member is disposed closest to said first end of said passage, thereby opening said nozzle for maximum flow of said material, and a constant cross-sectioned space between said constant cross-sectioned portion of said shaft and interior walls of a constant cross-sectioned portion of said passage, said constant cross-sectioned space extending outwardly from said second end of said passage, to the first-to-be encountered of said first and second flared surfaces, when said shaft is adjusted in said full open position, with said male member being disposed closest to said first end of said passage.

2. A nozzle as in claim 1 and including a continuous path at all conditions of operation, including stoppage of flow of said material, said continuous path extending from said means for introducing material into said chamber, through said passage and out said first end of said passage.

3. A nozzle as in claim 2, said angles of flare on said first and second surfaces being between 20 degrees and 40 degrees from said longitudinal axis.

4. A nozzle as in claim 2, said angles of flare on said first and second surfaces being between 20 degrees and 30 degrees from said longitudinal axis.

5. A nozzle as in claim 1, said angles of flare on said first and second surfaces being between 20 degrees and 40 degrees from said longitudinal axis.

6. A nozzle as in claim 5 wherein the ratio of the length of said passage to the diameter of said passage is at least about 0.8/1.

7. A nozzle as in claim 1, said angles of flare on said first and second surfaces being between 20 degrees and 30 degrees from said longitudinal axis.

8. A nozzle as in claim 1 wherein the ratio of the length of said passage to the diameter of said passage is at least about 0.8/1.

9. A nozzle as in claim 1, said operating range including a withdrawn position at a second end of said range wherein said enlarged tip is withdrawn into said passage, inwardly of said first flared surface, and wherein said nozzle has an annular orifice with a clearance around said tip of about 0.001 to about 0.002 inch between said tip and said passage.

10. A nozzle as in claim 9 and including a continuous path at all conditions of operation, including stoppage of flow of said material, said continuous path extending from said means for introducing material into said chamber, through said passage and out said first end of said passage.

11. A nozzle as in claim 1 wherein said first surface is flared outwardly at an average angle no greater than 75 degrees from said longitudinal axis, said second surface being flared outwardly at least 15 degrees from said longitudinal axis, the angle of flare on said first surface being no more than 20 degrees less, nor more than 30 degrees greater, than said angle of flare on said second surface.

12. A nozzle as in claim 11 and including a continuous path at all conditions of operation, including stoppage of flow of said material, said continuous path extending from said means for introducing material into said chamber, through said passage and out said first end of said passage.

13. A nozzle comprising a housing having a first end, a passage in said housing, and means for communicating a drywall coating material into and through said passage, said passage having first and second ends and a longitudinal axis, said passage extending, from said first end of said housing at said first end of said passage, into the interior of said housing, and opening into a chamber in said housing at said second end of said passage, said first end of said passage having a first surface flared outwardly, a male member in said housing, having an end disposed toward said first end of said passage, a shaft comprising an elongated constant cross-sectioned portion extending from said end of said male member and from said chamber, through said passage, and terminating at an enlarged tip extending from said constant cross-sectioned portion at a location adjacent said first end of said passage, said enlarged tip having a second surface flared outwardly from said constant cross-sectioned portion of said shaft at least 15 degrees from said longitudinal axis adjusting means for adjusting the position of said shaft longitudinally in said passage within an operating range, for modifying the pattern of dispensing of said material, including a full open position at a first end of said range wherein said end of said male member is disposed closest to said first end of said passage, thereby opening said nozzle for maximum flow of said material, a constant cross-sectioned space between said constant cross-sectioned portion of said shaft and interior walls of a constant cross-sectioned portion of said passage, said constant cross-sectioned space extending outwardly from said second end of said passage to the first-to-be encountered of said first and second flared surfaces, when said shaft is adjusted in said full open position, with said male member being disposed closest to said first end of said passage, said nozzle having an annular orifice with clearance around said tip of about 0.001 to 0.002 inch between said tip and said passage when said enlarged tip is withdrawn into said passage, the combination of said constant cross-sectioned space and said first and second flared surfaces cooperating, in communication of said drywall coating material through said nozzle at pressure of 1000 psi to 1500 psi, to break up said drywall coating material, made by mixing together 25 pounds of drywall powder and 1.5 gallons of water to make a paste, then adding 1 part water to 1 part paste by volume, into discrete particles and thereby to create a substantially uniform pattern of said material being projected from said nozzle, whereby said material can be projected from said nozzle in a substantially uniform pattern of said discrete particles to thereby apply a textured coating to a surface.

14. A nozzle as in claim 13, and including a continuous path at all conditions of operation, including stoppage of flow of said material, said continuous path extending from said means for introducing material into said chamber, through said passage and out said first end of said passage.

15. A nozzle as in claim 13, said angles of flare on said first and second surfaces being between 20 degrees and 40 degrees from said longitudinal axis.

16. A gun for projecting drywall coating material outwardly therefrom, said gun comprising:

(a) means for receiving a supply of said drywall coating material;

(b) valve means to control passage of said drywall coating material through said gun; and (c) a nozzle comprising (i) a housing having first and second ends, a passage in said housing, and means for introducing said material into said chamber for communicating said material through said passage, said passage having first and second ends and a longitudinal axis, said passage extending from said first end of said housing at said first end of said passage, into the interior of said housing, and opening into a chamber in said housing at said second end of said passage, said first end of said passage having a first surface flared outwardly, (ii) a male member in said housing, having an end disposed toward said first end of said passage, (iii) a shaft comprising an elongated constant cross-sectioned portion extending from said end of said male member and from said chamber, through said passage, an enlarged tip, extending from said constant cross-sectioned portion, at a location adjacent said first end of said passage, said enlarged tip having a second surface flared outwardly from said constant cross-sectioned portion of said shaft at least 15 degrees from said longitudinal axis, (iv) adjusting means for adjusting the position of said shaft longitudinally in said passage within an operating range, for modifying the pattern of dispensing of said material, including a full open position at a first end of said range wherein said end of said male member is disposed closest to said first end of said passage, thereby opening said nozzle for maximum flow of said material, (v) a constant cross-sectioned space between said constant cross-sectioned portion of said shaft and interior walls of a constant cross-sectioned portion of said passage, said constant cross-sectioned space extending outwardly from said second end of said passage to the first-to-be-encountered of said first and second flared surfaces, when said shaft is adjusted in said full open position, with said male member being disposed closest to said first end of said passage, said nozzle having an annular orifice with a clearance around said enlarged tip of about 0.001 to about 0.002 inch between said tip and said passage when said tip is withdrawn into said passage said valve means for controlling the passage of said drywall coating material through said gun being located upstream, of flow of said coating material, from said means for introducing said material into said chamber, the combination of said constant cross-sectioned space and said first and second flared surfaces cooperating, in communication of said drywall coating material through said nozzle at pressures of 1,000 psi to 1,500 psi, to break up said drywall coating material into discrete particles and thereby to create a substantially uniform pattern of said material being projected, whereby said coating material can be projected from said gun in a substantially uniform pattern to thereby apply a textured coating to a surface.

17. A gun as in claim 16 and including, in said nozzle, a continuous path at all conditions of operation, including stoppage of flow of said material, said continuous path extending from said means for introducing material into said chamber, through said passage and out said first end of said passage.

18. A gun as in claim 17 wherein, in said nozzle, said angles of flare on each of (i) said first end of said passage and (ii) said tip are between 20 degrees and 40 degrees from said longitudinal axis.

19. A gun as in claim 17 wherein, in said nozzle, said angles of flare on each of (i) said first end of said passage and (ii) said tip being between 20 degrees and 30 degrees from said longitudinal axis, and wherein the ratio of the length of said passage to the diameter of said passage is at least about 0.8/1.

20. A gun as in claim 16 wherein, in said nozzle, said angles of flare on each of (i) said first end of said passage and (ii) said tip are between 20 degrees and 40 degrees from said longitudinal axis.

21. A gun as in claim 16 wherein, in said nozzle, said angles of flare on each of (i) said first end of said passage and (ii) said tip are between 20 degrees and 30 degrees from said longitudinal axis, and wherein the ratio of the length of said passage to the diameter of said passage is at least 0.8/1.

* * * * *